US011676736B2

(12) United States Patent
Pfeifer et al.

(10) Patent No.: US 11,676,736 B2
(45) Date of Patent: Jun. 13, 2023

(54) VENTILATED METAL STORAGE OVERPACK (VMSO)

(71) Applicant: NAC International Inc., Norcross, GA (US)

(72) Inventors: Holger Pfeifer, Norcross, GA (US); Jay G. Wellwood, Peachtree Corners, GA (US); George C. Carver, Norcross, GA (US)

(73) Assignee: NAC INTERNATIONAL INC., Norcross, GA (US)

( * ) Notice: Subject to any disclaimer, the term of this patent is extended or adjusted under 35 U.S.C. 154(b) by 151 days.

(21) Appl. No.: 16/161,910

(22) Filed: Oct. 16, 2018

(65) Prior Publication Data

US 2019/0131024 A1 May 2, 2019

Related U.S. Application Data

(60) Provisional application No. 62/578,758, filed on Oct. 30, 2017.

(51) Int. Cl.
*G21F 5/008* (2006.01)
*G21F 5/10* (2006.01)
(Continued)

(52) U.S. Cl.
CPC ..... *G21F 5/008* (2013.01); *G21F 1/125* (2013.01); *G21F 5/00* (2013.01); *G21F 5/06* (2013.01); *G21F 5/10* (2013.01); *G21F 5/005* (2013.01)

(58) Field of Classification Search
CPC . G21F 5/00; G21F 5/002; G21F 5/005; G21F 5/008; G21F 5/015; G21F 5/10; G21F 1/12; G21F 1/125
See application file for complete search history.

(56) References Cited

U.S. PATENT DOCUMENTS 3,754,140 A * 8/1973 Beierle ..... G21F 5/08 250/507.1
3,780,306 A * 12/1973 Anderson ..... G21F 5/10 250/428

(Continued)

FOREIGN PATENT DOCUMENTS

CN 103345955 A 10/2013
FR 2467468 A1 4/1981

(Continued)

OTHER PUBLICATIONS

Pennington, C. W. "Nac Technology and Experience: 2012 in Review" INMM Spent Fuel Management Seminar XXVIII, 2013, available at https://rampac.energy.gov/docs/default-source/education/q14.pdf. (Year: 2013).*

(Continued)

*Primary Examiner* — Sharon M Davis
(74) *Attorney, Agent, or Firm* — Thomas | Horstemeyer, LLP

(57) ABSTRACT

A storage apparatus is provided for dry storage of radioactive nuclear waste. The storage apparatus comprises a sealed canister containing the radioactive nuclear waste and an outer ventilated metal storage overpack (VMSO). The VMSO has a plurality of vents to enable ambient air flow through the VMSO and around the canister to thereby dissipate heat from the canister. The VMSO has a side wall having an inner metal layer and one or more sets of alternating layers. Each set includes a neutron absorbing layer adjacent to another metal layer so that neutron absorbing and metal layers alternate throughout the side wall. The neutron absorbing layer or layers are designed to absorb neutron particles radiated from the radioactive nuclear waste and the metal layers are designed to absorb gamma particles radiated from the radioactive nuclear waste as well as (Continued)

radiated from the neutron absorbing layer or layers that result from reactions associated with absorption of neutron particles.

16 Claims, 1 Drawing Sheet

(51) Int. Cl.

| | |
|---|---|
| ***G21F 1/12*** | (2006.01) |
| ***G21F 5/06*** | (2006.01) |
| ***G21F 5/00*** | (2006.01) |
| *G21F 5/005* | (2006.01) |

(56) References Cited

U.S. PATENT DOCUMENTS

| | | | | |
|---|---|---|---|---|
| 4,634,875 | A * | 1/1987 | Kugeler | G21F 9/34 250/506.1 |
| 5,262,463 | A | 11/1993 | Berzen | |
| 5,786,611 | A * | 7/1998 | Quapp | G21F 1/042 250/515.1 |
| 6,519,307 | B1 * | 2/2003 | Singh | G21F 5/10 250/506.1 |
| 7,312,466 | B2 | 12/2007 | Caldwell | |
| 7,449,131 | B2 | 11/2008 | Hayner | |
| 10,373,722 | B2 | 8/2019 | Singh | |
| 10,811,154 | B2 * | 10/2020 | Singh | B23K 9/0026 |
| 2008/0069291 | A1 * | 3/2008 | Singh | G21F 5/00 376/272 |
| 2009/0114856 | A1 * | 5/2009 | Shimojo | G21F 5/08 250/506.1 |
| 2010/0284506 | A1 * | 11/2010 | Singh | G21F 5/10 376/272 |
| 2010/0324350 | A1 * | 12/2010 | Shaw | G21F 9/36 588/16 |
| 2012/0142991 | A1 | 6/2012 | Singh et al. | |
| 2014/0177775 | A1 * | 6/2014 | Loewen | G21H 1/103 376/272 |
| 2014/0329455 | A1 | 11/2014 | Singh | |
| 2015/0069274 | A1 | 3/2015 | Agace | |
| 2015/0206610 | A1 | 7/2015 | Carver et al. | |
| 2019/0103197 | A1 * | 4/2019 | Singh | G21F 9/34 |

FOREIGN PATENT DOCUMENTS

| | | | |
|---|---|---|---|
| GB | 2096046 | A | 10/1982 |
| JP | 200469473 | A | 10/2013 |
| JP | 6140760 | B2 | 5/2017 |
| TW | M373551 | | 2/2010 |

OTHER PUBLICATIONS

Green, S. et al., Storage and Transport Cask Data For Used Commercial Nuclear Fuel, ATI-TR-13047, 2013, available at https://www.osti.gov/servlets/[url/1553317. (Year: 2013).*

NRC. "Shielding Radiation: Alphas, Betas, Gammas and Neutrons" NRC Documents, Jul. 5, 2011, https://www.nrc.gov/docs/ML1122/ML11229A721.pdf (Year: 2011).*

Sazali, Muhammad Arif, Nahrul Khair Alana Md Rashid, and Khaidzir Hamzah. "A review on multilaver radiation shielding." IOP Conference Series: Materials Science and Engineering. vol. 555. No. 1. IOP Publishing, 2019. (Year: 2019).*

Waly, El-Sayed A., Michael A. Fusco, and Mohamed A. Bourham. "Impact of specialty glass and concrete on gamma shielding in multi-layered PWR dry casks." Progress in Nuclear Energy 94 (2017): 64-70. (Year: 2017).*

International Preliminary Report on Patentability in PCT/US18/57935 dated Jan. 31, 2020.

International Search Report and Written Opinion in PCT/US18/57935 dated Jan. 15, 2019, 15 pages.

Taiwan Office Action in co-pending, related Taiwan application No. 107138315, dated Nov. 30, 2020.

Taiwan Office Action in co-pending, related Taiwan application No. 107138315, dated Aug. 2, 2020.

Extended European Search Report for EP Patent Application No. 18873970 dated Jul. 1, 2021.

Korean Office Action dated Jan. 25, 2023, English Translation Included.

* cited by examiner

VENTILATED METAL STORAGE OVERPACK (VMSO)

CLAIM OF PRIORITY

This utility patent application claims the benefit of and priority to provisional application No. 62/578,758, filed Oct. 30, 2017, which is incorporated by reference herein in its entirety.

FIELD OF THE INVENTION

The present invention relates to storage apparatus and methods to safely dry storing canisters containing radioactive nuclear waste (e.g., spent nuclear fuel rods, radioactive materials, etc.).

BACKGROUND OF THE INVENTION

At commercial nuclear power plants, spent nuclear fuel has been stored in deep reservoirs of water, often called spent fuel pools, within the nuclear power plant. When these spent fuel pools reach their spent fuel capacity limits, or when the nuclear power plant undergoes a complete removal of spent fuel from the spent fuel pool at the end of the life of the facility, the fuel is transferred into metal canisters having final closure lids that are welded closed or sealed with mechanical means at the power plants following the spent fuel or radioactive waste loading. The sealed canister is then placed into a ventilated storage overpack (typically consisting of layers of steel and concrete) which serves as an enclosure that provides mechanical protection, passive heat removal features, and additional radiation shielding for the inner metal canister that contains the radioactive material. The ventilated storage overpack, containing the welded or bolted metal canister within which the radioactive materials are stored, is then placed in the designated secure location outside of the nuclear power plant structure yet on owner controlled property so as to ensure proper controls and monitoring are performed in connection with the ventilated storage overpack containing the metal canister.

These ventilated storage overpacks must meet only the regulatory requirements for storage and not the regulations associated with off-site transportation of the metal canisters. Regulations associated with off-site transportation require the use of a specially designed off-site transportation cask, which is quite different in design and materials from the ventilated storage overpack and licensed for use by the regulatory authorities under different rules and regulations than those used to authorize ventilated storage overpacks.

The ventilated storage overpack is designed to: (1) limit ionizing radiation; (2) provide suitable structural protection of the metal canister from external threats; and (3) provide passive heat removal from the contents stored within the metal canister that is stored within the ventilated storage overpack. To satisfy these basic functional attributes, the ventilated storage overpack has typically been constructed from a combination of steel and concrete, which has required that it have a large diameter. This large diameter presents an issue for the users that have areas that are limited in physical size available for deployment of these types of large diameter containers during both operating and decommissioning status.

As an alternative to the concrete and metal ventilated storage overpack previously described, commercial nuclear power plants may choose to utilize a metal based storage system which is also designed to: (1) limit ionizing radiation; (2) provide suitable structural protection of the metal canister from external threats; and (3) provide passive heat removal from the contents stored within the metal canister that is stored within the metal storage overpack. These dual purpose metal storage overpacks are also used to transport the contents after some period of interim storage and therefore are smaller in diameter. Due to the design of the metal storage overpack, it is not ventilated and therefore is considerably restricted in its ability to passively reject heat from the contents stored within it. Based on this very nature, the fuel contents selected for loading of these systems is limited to lower heat loads when compared to the higher heat load storage capacity afforded by the ventilated storage overpack design.

SUMMARY OF THE INVENTION

The present disclosure provides various embodiments of a ventilated metal storage overpack (VMSO) designed to minimize (1) the area required to store a canister having radioactive nuclear waste and (2) radiation emitted to personnel from the contents stored within, while maximizing the passive heat removal capability of the storage system without reducing the protection of the stored contents from external threats.

One embodiment, among others, is a storage apparatus that comprises a sealed canister containing the radioactive nuclear waste and an outer ventilated metal storage overpack (VMSO). The VMSO has a plurality of vents to enable ambient air flow through the VMSO and around the canister to thereby dissipate heat from the canister. The VMSO has a side wall having an inner metal layer and one or more sets of alternating layers. Each set includes a neutron absorbing layer adjacent to another metal layer so that neutron absorbing and metal layers alternate throughout the side wall. The neutron absorbing layer or layers are designed to absorb neutron particles radiated from the radioactive nuclear waste and the metal layers are designed to absorb gamma particles radiated from the radioactive nuclear waste as well as radiated from the neutron absorbing layer or layers that result from absorption of neutron particles.

Although not limited to these specific materials, in the preferred embodiments, the metal layers are carbon steel and the neutron absorbing layer or layers are a polymer material, cementitious material, a metallic material, or combination thereof. Furthermore, in any of the embodiments, the steel layers can be different steel materials, and the neutron absorbing layers can be different neutron absorbing materials.

Another embodiment, among others, is a storage apparatus that comprises a sealed canister containing the radioactive nuclear waste and a VMSO. The WMSO has a plurality of vents to enable ambient air flow through the VMSO and around the canister to thereby dissipate heat from the canister. The VMSO has a side wall with five layers, including a first layer (innermost), a second layer adjacent to the first layer, a third layer adjacent to the second layer, a fourth layer adjacent to the third layer, and a fifth layer (outermost) adjacent to the fourth layer. In this embodiment, the first, third, and fifth layers are made of a metal material and the second and fourth layers are made of a neutron inhibiting material. The neutron absorbing layers are designed to absorb neutron particles radiated from the radioactive nuclear waste and the metal layers are designed to absorb gamma particles radiated from the radioactive nuclear waste as well as radiated from the neutron absorbing layer or layers that result from absorption of neutron particles.

Other embodiments, apparatus, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE INVENTION

Figure 1:
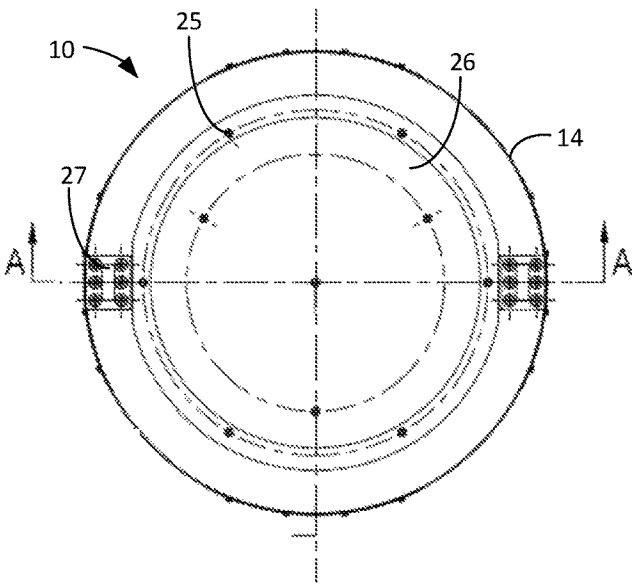
FIG. 1 is a top view of a preferred embodiment of the ventilated metal storage overpack (VMSO) of the present invention.

The ventilated metal storage overpack (VMSO) utilizes a combination of dense neutron radiation absorbing materials layered within steel shells such that the overall diameter of the VMSO is minimized in comparison to the metal-concrete storage overpacks of the prior art, while serving to at least: (1) provide personnel radiological protection from the contents stored within the metal canister; (2) protect the radioactive contents stored within the metal canister from external events; (3) maximize the ability to reject heat from the contents stored within the metal canister while (4) minimize the physical area required for each storage system. By alternating the use of dense neutron absorbing material together with the physical protection of the steel used in the VMSO, the personnel protection from the radiation being emitted can be maximized, the overall diameter of the system can be minimized, and the heat rejection capability of the system can be maximized without reducing the protection capability of the system from external effects.

The dense neutron attenuating material used within the VMSO (may be metallic, polymer, or cementitious in form coupled with any specified neutron absorbing type material) as selected by the designed based on the specific needs of the application which include the physical space availability (i.e., the maximum diameter of the system and number of systems needed) and the radiation levels on the exterior of the VMSO. The design may include three or more alternating layers of steel and dense neutron absorbing materials to form the VMSO. Further, the density of the neutron absorbing materials may be varied to maximize the effect of the materials when analyzed and constructed within two or more alternating layers of steel so as to reduce any gamma radiation that may be emitted from materials as a result of the neutron attenuation. Because of the strategic placement of the dense neutron absorbing materials within alternating layers of steel, the design of the VMSO can be enhanced specifically to diminish the amount of radiation being emitted from the VMSO, while minimizing the overall diameter of the VMSO thereby optimizing the system design which enhances the VMSO in comparison to the standard ventilated metal and concrete storage overpack and more closely resembles a metal storage overpack from a diametrical comparison.

By ventilating the VMSO, the heat rejection capability of the VMSO closely resembles the heat rejection capability of the typical ventilated metal and concrete storage overpack without the increased diameter associated with the typical ventilated metal and concrete storage overpacks of the prior art.

Furthermore, by strategic design and placement of the dense neutron absorbing material, the neutron and gamma radiation emitted from the VMSO can be minimized using the specific energy levels of the neutron and gamma radiation levels being emitted from the contents within the VMSO. The neutron absorbing material can be a metallic material (e.g., metamic, etc.) and/or a non-metallic material, such as a polymer (e.g., an NS4 polymer, a polymer doped with Boron, etc.) or a cementitious material (e.g., a cementitious material doped with Boron, etc.).

Figure 2:
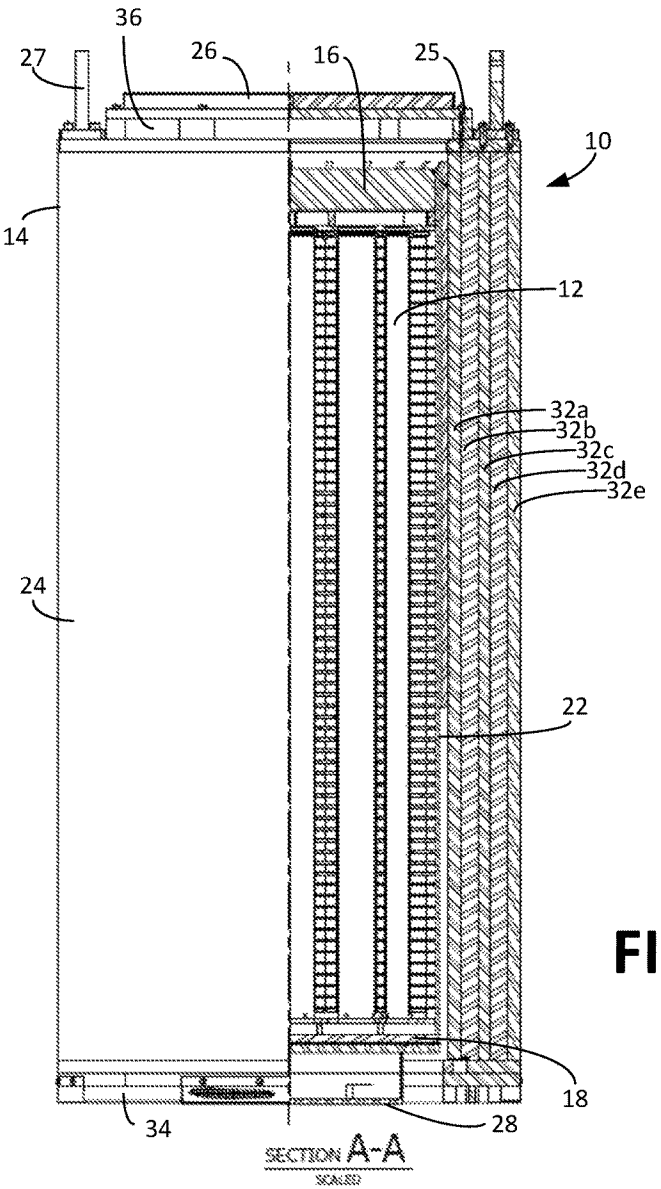
FIG. 2 is a partial cross sectional view of the preferred embodiment of the VMSO of FIG. 1, taken along cross section line A-A of FIG. 1.

Referring now to the figures, FIG. 1 is a top view of a preferred embodiment of the VMSO, denoted by reference numeral 10, and FIG. 2 is a partial cross sectional view of the VMSO 10, taken along cross section line A-A of FIG. 1. The VMSO 10 has a sealed elongated cylindrical canister 12 containing the hazardous nuclear material, for example but not limited to, spent nuclear fuel rods, etc., and a elongated cylindrical VMSO 14 containing the canister 12.

The canister 12 has a mounted removable circular top lid 16, a circular flat bottom 18, and an elongated cylindrical side wall 22 extending between the lid 16 and the flat bottom 18. The canister 12 is shown, as an example, with tubes and disks, but other types of canisters 12 may be utilized. Generally, the canister 12 can implement any conductive or convective heat transfer scheme and is made from stainless steel parts. Other non-limiting examples of suitable canisters are described in U.S. Pat. Nos. 9,558,857 and 6,784,443, the disclosures of which are incorporated herein by reference in their entireties.

The VMSO 14 has a cylindrical longitudinal body 24 extending between a mounted removable circular top lid 26 and a circular flat bottom 28. As an example, the top lid 26 is shown bolted to the body 24 via a plurality of bolts 25. The top lid 26 could also be welded to the body 24 or otherwise attached.

The top of the longitudinal body 24 also has a plurality of bolted lift lugs 27 that enable the VMSO 14 to be moved with, for example, a conventional crane. As an alternative embodiment, the longitudinal body 24 could be equipped with a plurality of trunnions.

The bottom 28 is welded to, bolted to, or otherwise attached to the longitudinal body 24 of the VMSO 14.

The longitudinal body 24 has at least three layers 32: an inside layer, at least one middle layer adjacent to the inside layer, and an outside layer adjacent to the at least one middle layer, with the inside and outside layers being metal, preferably but not limited to carbon steel, and the at least one middle layer comprising a neutron inhibiting material. In this embodiment, neutron particles pass through the first layer of carbon steel and are sufficiently attenuated and/or captured by the single layer of neutron absorbing material. Moreover, gamma particles from the canister 12 are absorbed and attenuated by the multiple layers of carbon steel, and any additional gamma particles spawned by absorption by neutron particles in the neutron absorbing layer are sufficiently attenuated and/or captured in the outer carbon steel layer.

In the preferred embodiment, as shown in FIG. 2, the layers 32 (or shells) include a first layer 32*a*, a second layer 32*b* adjacent to the first layer 32*a*, a third layer 32*c* adjacent to the second layer 32*b*, a fourth layer 32*d* adjacent to the third layer 32*c*, and a fifth layer 32*e* adjacent to the fourth layer 32*d*. Moreover, the first, third, and fifth layers 32*a*, 32*c*, and 32*e* are made of metal, preferably but not limited to, carbon steel, and the second and fourth layers 32*b* and 32*d* are made of a neutron inhibiting material, such as a metallic, polymer, and/or a cementitious material.

In this preferred embodiment, the three carbon steel layers and two neutron absorbing layers effectively and efficiently assist with attenuation of the neutron and gamma particles that escape from the canister 12. More specifically, neutron particles may be at different energy levels. The neutron particles will pass through the steel layers. Moreover, some will be slowed down but will pass through the first neutron absorbing layer, but will be captured by the second neutron absorbing layer. As the neutron particles are absorbed, additional gamma particles may be spawned and emitted, but they are attenuated and absorbed by the multiple carbon steel layers.

The VMSO 14 is designed with a plurality of screened vents to enable ambient air flow through the VMSO 14 from the bottom end to the top end. For example, the VMSO 14 is shown with air inlets 34 in the bottom 28 at the bottom end and air outlets 36 in the top lid 26 at the top end so that ambient air enters at or near the bottom end, passes through the VMSO 14 along the outside of the canister 12 to thereby dissipate canister heat, and then out of the VMSO 14 at or near the top end. The vents also enable drainage and evaporation of water to keep the interior of the VMSO 14 sufficiently dry.

It should be emphasized that the above-described embodiments of the present invention, particularly, any "preferred" embodiments, are merely possible nonlimiting examples of implementations, set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention.

The invention claimed is:

1. A storage apparatus for dry storage of radioactive nuclear waste, comprising:

a canister configured to contain radioactive nuclear waste, the canister being an elongated cylindrical sealed canister comprising a circular top lid and a circular flat bottom; and a ventilated metal storage overpack (VMSO) containing the canister, the VMSO having a longitudinal body extending between a top at a top end and a bottom at a bottom end, the VMSO comprising a plurality of screened vents that enable ambient air flow through the VMSO from the bottom end to the top end to dissipate heat from the canister and permit evaporation, the plurality of screened vents comprising a plurality of air inlets positioned at the bottom end and a plurality of air outlets positioned at the top end, the longitudinal body of the VMSO being elongated and cylindrical, and having a sidewall with five layers that extend vertically above the circular top lid of the canister and below the circular flat bottom of the canister, the five layers comprising a first layer, a second layer adjacent to the first layer, a third layer adjacent to the second layer, a fourth layer adjacent to the third layer, and a fifth layer adjacent to the fourth layer;

wherein the first layer, the third layer, and the fifth layer are each formed of carbon steel configured to absorb gamma particles radiated from the radioactive nuclear waste; and wherein the second layer and the fourth layer are each formed of a neutron inhibiting material configured to absorb neutron particles radiated from the radioactive nuclear waste, the neutron inhibiting material of the second layer and the fourth layer each comprise a polymer material doped with Boron or a cementitious material doped with Boron, and a density of the neutron inhibiting material of the second layer differs from a density of the neutron inhibiting material of the fourth layer to reduce emitted gamma radiation resulting from neutron attenuation.

2. The apparatus of claim 1, wherein the neutron inhibiting material further comprises a metallic portion.

3. The apparatus of claim 2, wherein the metallic portion comprises an aluminum-boron carbide metal matrix composite material.

4. The apparatus of claim 1, wherein the polymer material doped with Boron is a boron-containing epoxy resin, and the second layer and the fourth layer are each formed of a boron-containing epoxy resin having different densities.

5. The apparatus of claim 1, wherein the five layers exhibit, together, a sufficient neutron inhibiting characteristic and a sufficient gamma inhibiting characteristic so that substantially no neutron and gamma radiation escapes through the VMSO to an outside thereof.

6. The apparatus of claim 1, wherein the neutron inhibiting material is the polymer material doped with Boron.

7. The apparatus of claim 1, wherein the neutron inhibiting material is the cementitious material doped with Boron.

8. The apparatus of claim 1, wherein the top of the VMSO comprises one of a plurality of bolted lift lugs or a plurality of trunnions for moving the VMSO.

9. A method, comprising:

providing a storage apparatus for dry storage of radioactive nuclear waste, comprising:

a canister configured to contain radioactive nuclear waste, the canister being an elongated cylindrical sealed canister comprising a circular top lid and a circular flat bottom; and a ventilated metal storage overpack (VMSO) containing the canister, the VMSO having a longitudinal body extending between a top at a top end and a bottom at a bottom end, the VMSO comprising a plurality of screened vents that enable ambient air flow through the VMSO from the bottom end to the top end to dissipate heat from the canister and permit evaporation, the plurality of screened vents comprising a plurality of air inlets positioned at the bottom end and a plurality of air outlets positioned at the top end, the longitudinal body of the VMSO being elongated and cylindrical, and having a sidewall with five layers that extend vertically above the circular top lid of the canister and below the circular flat bottom of the canister, the five layers comprising a first layer, a second layer adjacent to the first layer, a third layer adjacent to the second layer, a fourth layer adjacent to the third layer, and a fifth layer adjacent to the fourth layer;

wherein the first layer, the third layer, and the fifth layer are each formed of carbon steel configured to absorb gamma particles radiated from the radioactive nuclear waste; and wherein the second layer and the fourth layer are each formed of a neutron inhibiting material configured to absorb neutron particles radiated from the radioactive nuclear waste, the neutron inhibiting material of the second layer and the fourth layer each comprise a polymer material doped with Boron or a cementitious material doped with Boron, and a density of the neutron inhibiting material of the second layer differs from a density of the neutron inhibiting material of the fourth layer to reduce emitted gamma radiation resulting from neutron attenuation.

10. The method of claim 9, wherein the neutron inhibiting material further comprises a metallic portion.

11. The method of claim 10, wherein the metallic portion comprises an aluminum-boron carbide metal matrix composite material.

12. The method of claim 9, wherein the polymer material doped with Boron is a boron-containing epoxy resin, and the second layer and the fourth layer are each formed of a boron-containing epoxy resin having different densities.

13. The method of claim 9, wherein the five layers exhibit, together, a sufficient neutron inhibiting characteristic and a sufficient gamma inhibiting characteristic so that substantially no neutron and gamma radiation escapes through the VMSO to an outside thereof.

14. The method of claim 9, wherein the neutron inhibiting material is the polymer material doped with Boron.

15. The method of claim 9, wherein the neutron inhibiting material is the cementitious material doped with Boron.

16. The method of claim 9, wherein the top of the VMSO comprises one of a plurality of bolted lift lugs or a plurality of trunnions for moving the VMSO.

* * * * *